US006735780B1

(12) United States Patent
Jaunault et al.

(10) Patent No.: US 6,735,780 B1
(45) Date of Patent: May 18, 2004

(54) FASTENING SYSTEM FOR A PROTECTIVE APRON

(75) Inventors: Philippe Jaunault, Villemoisan (FR); Jean-Pierre Bodard, Champtoce sur Loire (FR)

(73) Assignee: Manulatex France, Z.A., Champtoce sur Loire (FR)

( * ) Notice: Subject to any disclaimer, the term of this patent is extended or adjusted under 35 U.S.C. 154(b) by 0 days.

(21) Appl. No.: 10/018,800

(22) PCT Filed: Jun. 21, 2000

(86) PCT No.: PCT/FR00/01727

§ 371 (c)(1),
(2), (4) Date: Dec. 21, 2001

(87) PCT Pub. No.: WO00/78168

PCT Pub. Date: Dec. 28, 2000

(30) Foreign Application Priority Data

Jun. 21, 1999 (FR) ..... 99 08269

(51) Int. Cl.[7] ..... A41D 13/04
(52) U.S. Cl. ..... 2/48
(58) Field of Search ..... 2/48, 463, 455, 2/464–467, 2.5, 459–461, 468, 44–46, 462, 51, 52, 913

(56) References Cited

U.S. PATENT DOCUMENTS

| | | | | |
|---|---|---|---|---|
| 2,083,790 A | | 6/1937 | McGuire | |
| 2,442,895 A | | 7/1948 | Hill | |
| 2,451,282 A | | 10/1948 | Feibel | |
| 3,125,762 A | * | 3/1964 | Glahe | 2/463 |
| 4,272,847 A | * | 6/1981 | Buhler | 2/463 |
| 4,545,773 A | * | 10/1985 | Evert | 441/114 |
| 4,850,051 A | * | 7/1989 | Hodge | 2/52 |
| 6,182,299 B1 | * | 2/2001 | Chen | 2/463 |
| 6,421,833 B2 | * | 7/2002 | Khanamirian et al. | 2/69 |

FOREIGN PATENT DOCUMENTS

| | | |
|---|---|---|
| CH | 247975 | 9/1945 |

* cited by examiner

*Primary Examiner*—Tejash Patel
(74) *Attorney, Agent, or Firm*—Young & Thompson

(57) ABSTRACT

A fastening system includes (3) a flexible plastic neck-enclosing part (7), and a strap (13) arranged in a triangle between the sides of the apron and the rear part of the neck-enclosing part (7) to form both the belt (14) and the braces (15). The belt (14) includes a fast fixing attachment (16) such as a snap fastener and a length-adjusting system with a clip (17) provided on the strap (13) length, particularly on one of the braces (15). The belt-brace system enables to adjust with precision the position of the apron and particularly to distribute suitably the weight on the user's shoulders.

12 Claims, 4 Drawing Sheets

FASTENING SYSTEM FOR A PROTECTIVE APRON

This invention relates to a fastening system for a protective apron on the user, for example for aprons used by the people working in the field of butchery.

Such protective aprons are generally made of coat of mails or with metal plates assembled together with rings. The corresponding aprons are therefore relatively heavy and, to obtain efficient protection, they must be positioned correctly on the user, thereby covering the parts of the body that are particularly exposed to the sharp tips of knives.

Such aprons are generally hooked using braces, with a belt extending rearward to hug the user's waist. Because of their structure, they require from a user minimum time to putting such aprons on, especially for adjusting the belts. Such aprons also exhibit a certain complexity when the user must slip his arms and his head through the brace system.

Aprons are also known, as described in the document CH-204 829, which comprise a belt for hugging the waist with in addition, instead of braces, a neck-enclosing part that supports the apron at its upper section. The belt and the neck-enclosing part each comprise an adjustment buckle.

Such a type of apron has the shortcoming of the weight resting on the rear base of the user's neck and of forcing the latter to perform several adjustments each time the user puts the apron on.

The document U.S. Pat. No. 2,442,895 also describes a protective apron whose fastening system comprises a single strap that is arranged in a triangle between the sides of the apron, and a neck-enclosing part, to form braces and a belt. The neck-enclosing part is made of a single piece with the front section of the apron, and the user must connected both free ends of the single strap into a knot to put the item on.

There again, the clamping tension and the length of the braces must be adjusted each time the user puts the apron on.

This invention suggests a fastening system for an apron that enables the user to put his apron quickly on with no need to pay attention to any adjustments, which adjustments are reduced to a minimum and may be carried out once and for all if the apron is worn on a regular basis by the same user.

Moreover, the fastening system according to the invention enables better distribution of the weight of the apron over certain parts of the body in order to reduce the user's tiredness.

Such a protective apron is generally worn over another apron that forms a kind of lining enabling to protect the user's clothes. The user first of all puts this lining apron on, which is made of plastic material and fitted conventionally with braces and a belt; he then puts the protective apron on that forms a true armour.

This invention also suggests to simplify this type of lining apron while connecting it to the fastening system of the protective apron.

The fastening system according to this invention comprises a neck-enclosing part whose ends are attached in a removable fashion to the upper section of the apron, and a belt extending rearward while connecting the sides of the said apron. Such a belt has the shape of a strap arranged in a triangle between the sides of the apron and the dorsal end of the neck-enclosing part, which strap comprises, on the one hand, an attachment that is situated on the section acting as a belt and, on the other hand, means for adjusting its length.

Still according to the invention, from the fastening system located on the section acting as a belt, the sole strap extends toward the sides of the apron and goes back upwards to the neck-enclosing part to form the braces, one of the ends of this strap passes through a buckle provided on the said fastening system to provide a return section fitted with a clip suitably designed to be interlocked on the said strap in order to form the length-adjusting means.

According to a preferred embodiment of the invention, the neck-enclosing part has the shape of a horseshoe whose both lateral bands have a selected width in order to distribute the pressure on the user's shoulders, and whose rear section, intended for extending on the user's back, comprises an eyelet for the free passage of the strap.

Still according to a preferred embodiment, the neck-enclosing part is made of plastic material, for instance cut into a plate; both its lateral bands comprise hooking means on the upper section of the apron and its rear section has the shape of a crescent.

The oblong orifice provided in these plates is preferably oriented in a direction perpendicular to the bisectrix of the angle formed by both strap sections extending from this orifice.

According to another feature of the invention, the neck-enclosing part of the fastening system comprises means for hooking at least one accessory. To this end, the neck-enclosing part can be fitted with one or several sections of a snap fastener suited for hooking the end of a glove-shoulder.

According to another characteristic, the neck-enclosing part is fitted with hooking means on the upper section of the apron, which are fastened to the ends of the lateral bands via a buckle closed by a section of a snap fastener with two identical male or female elements, mounted upside-down, which enable to fasten, on one side or the other, an add-on lining apron.

The lateral plates of the fastening system therefore comprise advantageously fastening means complementary to this lining apron.

The invention relates also to the protective apron comprising a fastening system as defined above; it also relates to a lining apron of plastic material, fitted with means that enable hooking the apron on the fastening system according to this invention.

The invention will also be detailed using the following description and the appended drawings, given for exemplification purposes and on which:

Figure 1:
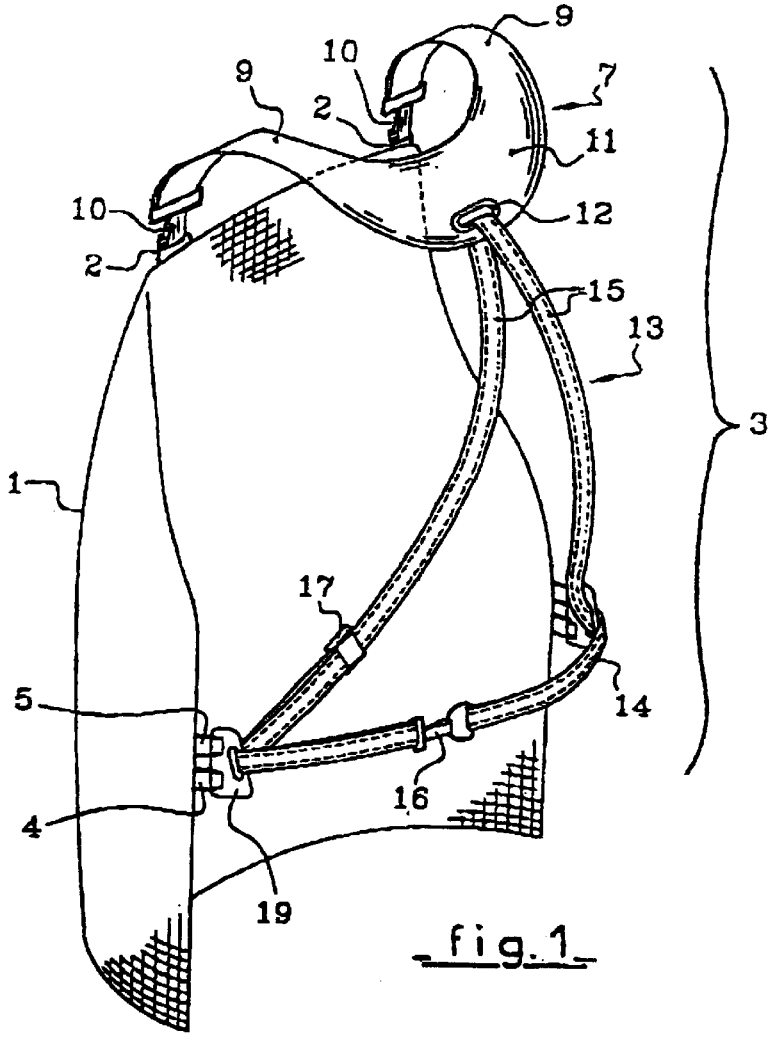
FIG. 1 represents the fastening system according to the invention and the protective apron, as worn by a non-appearing user.

The apron shown on FIG. 1 is for example a protective apron realised with a set of metal plates. This apron 1 may also be made of a coat of mail or another protective material suited to the usage. It covers all the surfaces of the body that are particularly exposed to the knife cuts notably.

The apron 1 comprises buckles 2 at its upper section intended for co-operating with the fastening systems 3. It also comprises laterally on its sides, buckles 4 and 5 intended for completing the anchoring of this fastening system.

The fastening system 3 comprises a neck-enclosing part 7. This U- or horseshoe shaped neck-enclosing part 7 is preferably made of plastic material and is obtained for example by cutting a plate with appropriate dimensions. This neck-enclosing part 7 comprises two lateral bands 9 whose ends are fitted with snap fasteners 10 that enable removable hooking on the buckles 2 located at the upper section of the apron. These bands 9 have such a width that they enable correct distribution of the pressure on the user's shoulders, which pressure is caused by the weight of the apron 1.

The rear section 11 of the neck-enclosing part 7 is in the form of a crescent. It is intended for applying on the user's back and shoulders and it contributes to suitable distribution of the pressure due to the weight of the apron.

This rear section 11 comprises an eyelet 12 centred on its end section, which enables to adjust the position of the neck-enclosing part and in particular to adjust the height of the apron 1, for correct adjustment of the position of the latter on the user's body.

This eyelet 12 enables the free passage of a single strap 13, which strap forms a kind of triangle in the user's back. This triangle can be decomposed into a section 14 acting as a belt between the sides of the apron, and a section 15 made of braces extending from the belt and the said sides, up to the neck-enclosing part 7.

The strap 13 is made of a single piece forming the belt 14 and the parts forming braces 15; it comprises at its ends a fastening system 16 in the form of a snap fastener for example, which is located on the section of the strap forming the belt 14, in the centre of the back, i.e. in a place where the user can handle it easily.

Figure 2:
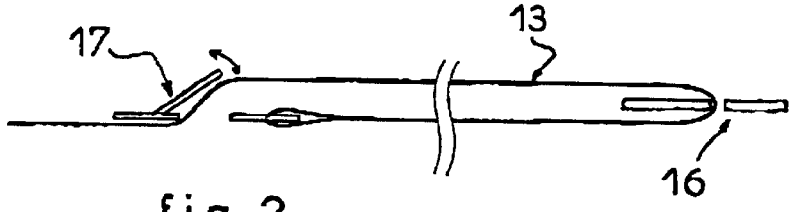
FIG. 2 illustrates the length-adjusting system of the strap of the fastening system according to this invention.

The length of the strap 13 is adjustable by means of a clip 17 with a removable lock provided on end return going through a buckle of the fastening system 16 (FIG. 2). The length-adjusting clip 17 can be locked on one of the braces 15; there is no ground for it to be handled each time the user puts the apron on.

This strap system 13 helps the user to put the apron on, by providing him much more room for slipping his arms between the braces 15 and the apron.

Figure 3:
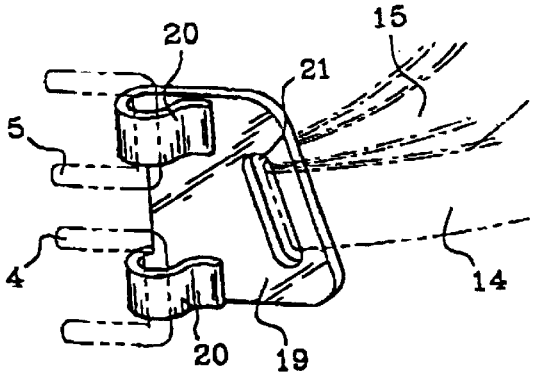
FIG. 3 represents the detail of the lateral fastening plates.

The belt 14 can be fastened on the lateral buckles 4 and 5, as represented on the details of FIG. 3, by means of an intermediate plate 19. This intermediate plate 19 can be made of metal or of rigid plastic material, it comprises hooks 20 that co-operate respectively with the buckles 4 and 5.

This plate 19 is fitted with an oblong orifice 21 that allows the parts of the strap 13 to go through, which parts form the belt 14 and the braces 15. This orifice 21 is oriented along a direction perpendicular to the bisectrix of the angle formed by the belt 14 and the corresponding brace 15.

The strap 13 slides freely through the eyelet 12 of the neck-enclosing part 7 and through the orifices 21 of the lateral plates 19. This feature provides the user with a lot of elbowroom; he is not bridled in anyway by the fastening system of the apron.

The hooks 20 of the plates 19 may be made of elastic folds forming simultaneously a kind of clip avoiding any untimely disconnection.

As seen previously, the protective aprons can be connected to a complementary lining apron (also called plastron) intended in particular for protecting the user's clothes. This lining structure is generally made of plastic material (rubber, polyurethane or other).

The purpose of the invention is to connect this kind of lining apron with the protective apron, in order to suppress the fastening means on the user that are adequate to the lining apron.

Figure 4:
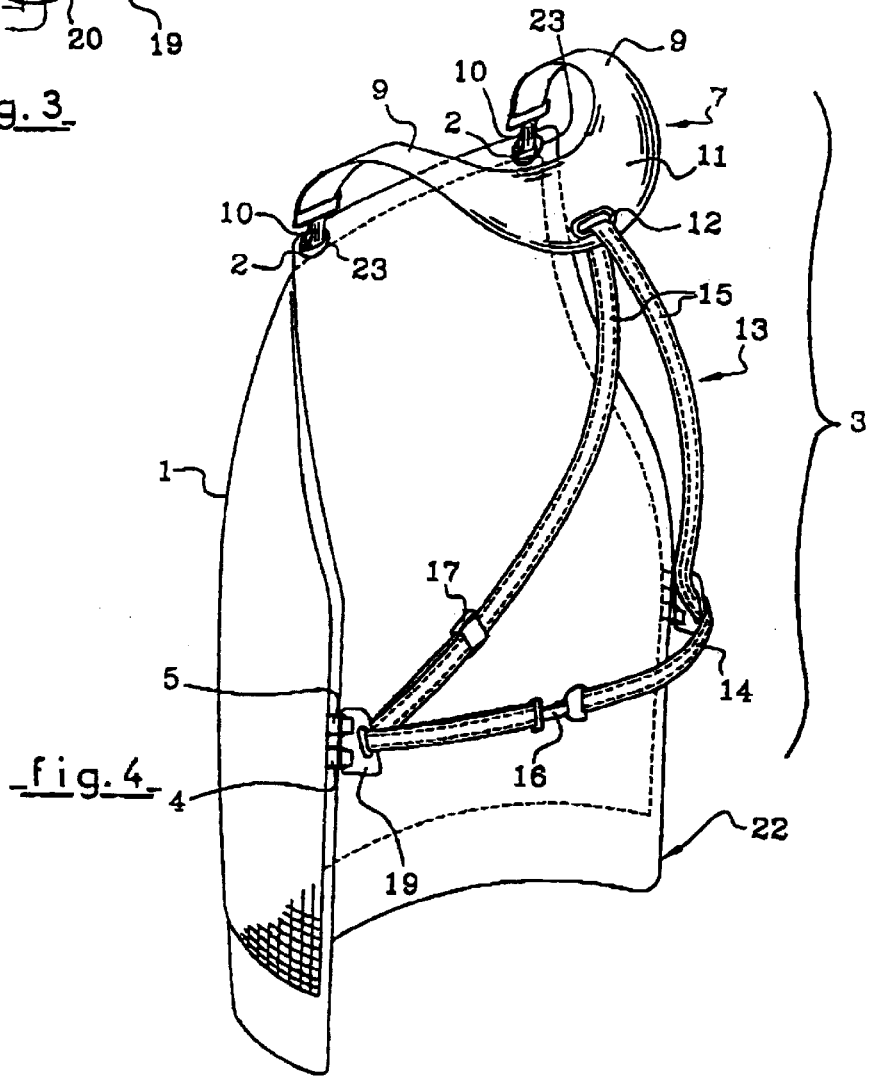
FIG. 4 represents the fastening system connected to the protective apron with, in addition, an apron acting as a lining to protect the user's clothes.

In a first possible embodiment, represented schematically on FIG. 4, the lining apron 22 simply comprises two orifices 23 or eyelets at its upper section that enables to connect the said apron to the snap fasteners 10 of the fastening system 3 of the protective apron 1.

The lining apron 22 can be hooked from the under side the protective apron 1, in particular to protect the user's clothes; on can also contemplate to hook the apron in the same manner on the top side.

Two lining structures 22 can also be used for dressing the top and the under faces of the protective apron.

The lining(s) 22 can also be fastened laterally on the sides of the apron 1 or on the plates 19, by appropriate means such as snap fasteners or other.

Figure 5:
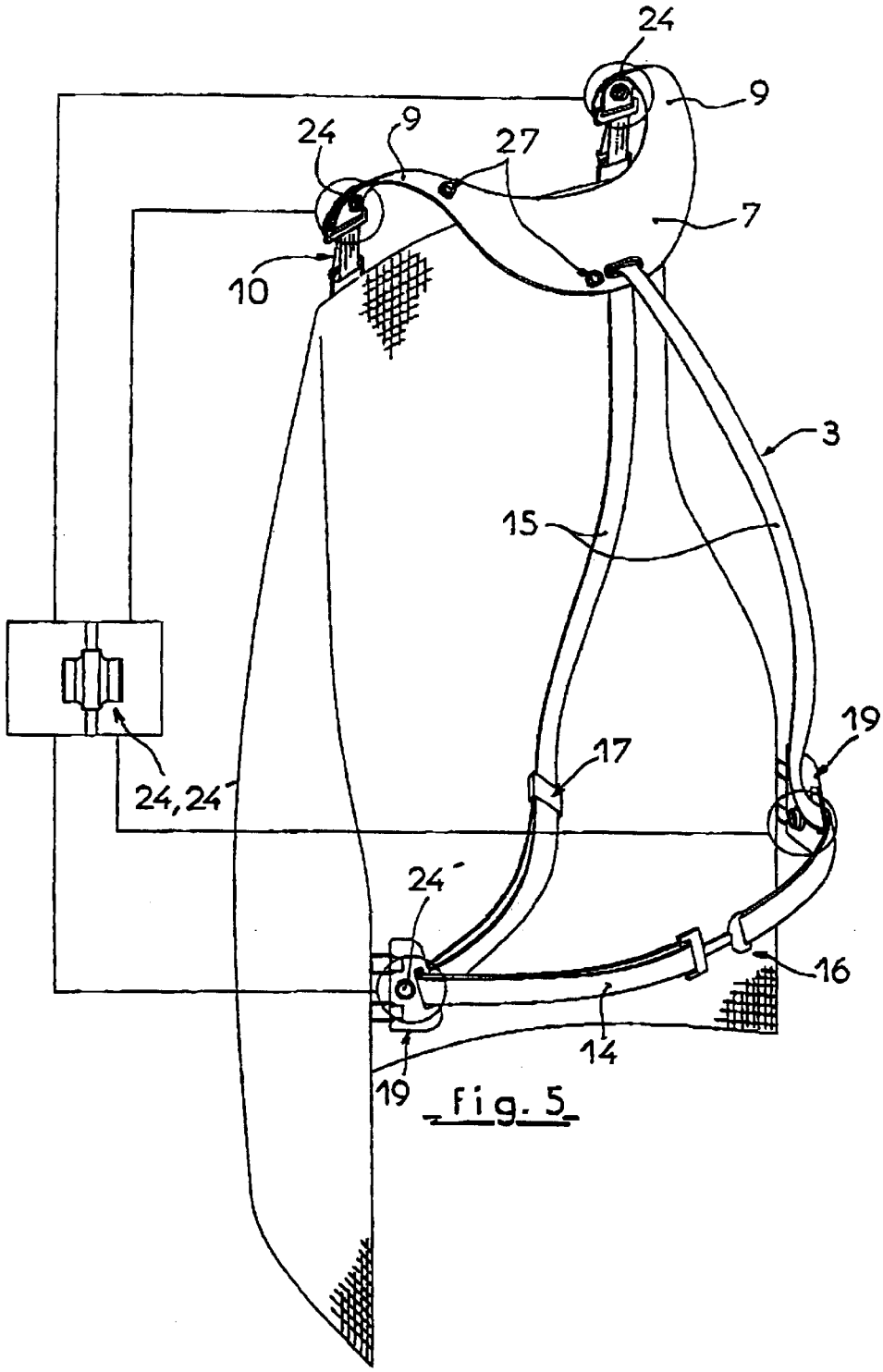
FIG. 5 illustrates a variation of the fastening system enabling to attach a lining apron.
Figure 6:
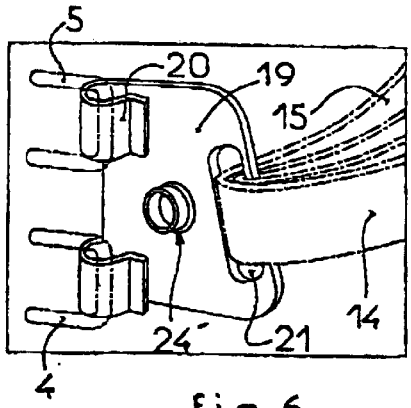
FIG. 6 represents the detail of the lateral plates for fastening the apron of the FIG. 5.
Figure 7:
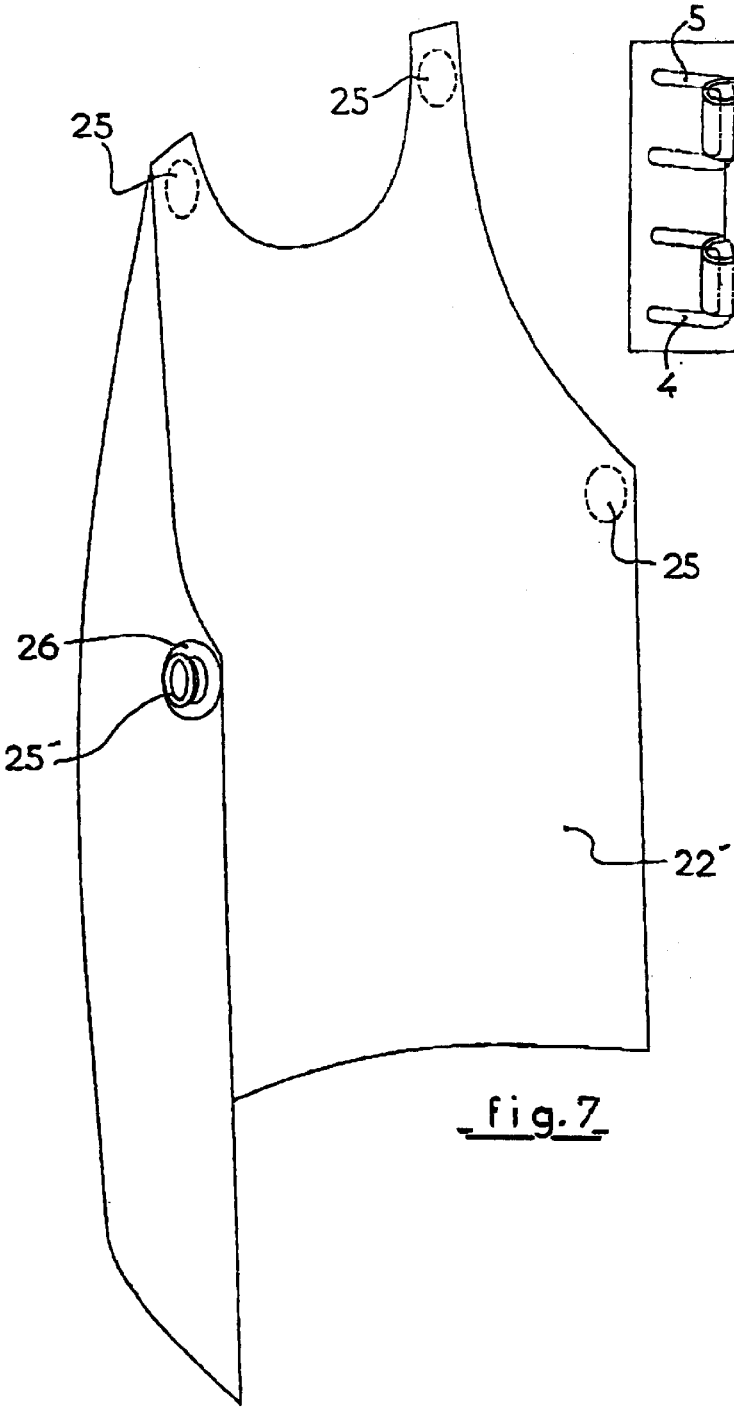
FIG. 7 shows the lining apron liable to be connected to the fastening system illustrated on FIG. 5.

FIGS. 5 to 7 illustrate another possible embodiment in which the lining apron 22' (FIG. 7) can be attached to the protective apron 1 (FIG. 5) by means of structures such as snap fasteners.

On the illustrated embodiment, the snap fasteners 10 of the fastening system 3 are hooked to the ends of the lateral bands 9 of the neck-enclosing part 7 by means of a buckle closed by a section of a snap fastener 24 fitted with two male balls upside down.

Moreover, in its upper section, the lining apron 22' comprises two female sections 25 of snap fastener type intended for co-operating with the snap fastener male sections 24 mentioned above, for hooking the said lining apron to the protective apron 1, as required, against its top face or against its under face (or both it two lining aprons 22' are used).

On the sides, the plates 19 of the protective apron are also fitted with snap fastener male sections 24', fitted with two upside down balls (FIGS. 5 and 6) that enable to hook one or both lining aprons 22' by means of snap fastener female sections 25' arranged correctly.

On the lining apron 22', the snap fastener female sections 25 and 25' are associated with reinforcement tabs 26 provided on either side.

As can be seen on FIG. 5, the neck-enclosing part 7 can also be fitted with one or several parts of a snap fastener 27 suited for hooking any kind of accessory. This or these parts of a snap fastener 27 can be adapted for hooking the end of a glove-shoulder made of a coat of mails protecting the whole arm of the user.

What is claimed is:

1. A fastening system for a protective apron comprising:

a neck-enclosing part (7) having ends which are attached to an upper section of the apron with hooking means (10), and having a rear section (11) comprising an eyelet (12), two plates (19) which are fitted with hooks (20) that cooperate with buckles (4, 5) provided on sides of the apron, each of the two plates (19) having an orifice (21), and a single strap (13) arranged in a triangle between said sides of the apron and said rear section (11) of the neck-enclosing part (7) to form a belt (14) and braces (15), the strap (13) passing freely through the eyelet (12) of the neck-enclosing part (7), and through the orifices (21) of the two plates (19), and the strap (13) comprises an attachment (16) that is situated on the belt section (14) between said sides of the apron and has means for adjusting a length thereof.

2. A fastening system for a protective apron according to claim 1, wherein said strap (13) extends from the fastening system (16) of the belt section (14) toward the sides of the apron and goes back upwards to the neck-enclosing part (7)

to form the braces (15), whereas one of the ends of the said strap (13) passes through a buckle provided on the said fastening system (16) to provide a return section fitted with a clip (17), which clip (17) is designed to be interlocked in a removable fashion on the said strap (13) in order to form the length-adjusting means.

3. A fastening system for a protective apron according to claim 1, characterised in that the neck-enclosing part (7) has the shape of a horseshoe whose both lateral bands (9) have a selected width in order to distribute the pressure on the user's shoulders, and whose rear section, intended for extending on the user's back, comprises said eyelet (12) for the free passage of the strap (13), and in particular the section forming the braces (15) of the said strap.

4. A fastening system for a protective apron according to claim 1, wherein the neck-enclosing part (7) has a rear section (11) that has the shape of a crescent.

5. A fastening system for a protective apron according to claim 1, wherein said plate (19) is fitted with an orifice (21) in the form of an oblong light for the free passage of the strap.

6. A fastening system for a protective apron according to claim 5, characterised in that the oblong orifice (21) provided in the plate (19) is oriented along a direction perpendicular to the bisectrix of the angle formed by the strap (13), and in particular formed by the belt (14) and the corresponding brace (15).

7. A fastening system for a protective apron according to claim 1, characterised in that it comprises a neck-enclosing part (7) fitted with means (27) for hooking at least one accessory.

8. A fastening system for a protective apron according to claim 7, characterised in that it comprises a neck-enclosing part (7) fitted with one or several sections of a snap fastener (27) suited for hooking the end of a glove-shoulder.

9. A fastening system for a protective apron according to claim 1, wherein said neck-enclosing part (7) is fastened by the ends of lateral bands (9) via a buckle closed by a section of a snap fastener (24) with two identical male or female elements, mounted upside-down, which enable to fasten, on one side or the other, an add-on lining apron (22').

10. A fastening system for a protective apron according to claim 1, wherein each of the two plates (19) which are fitted with fastening means (24') for attaching an add-on lining apron (22') thereto.

11. A protective apron comprising a fastening system according to claim 1.

12. An apron forming a lining (22, 22') made of plastic material, characterised in that it comprises means (23; 25, 25') that enable to hook the said apron to the fastening system according to claim 1.

* * * * *